US009649003B2

(12) United States Patent
Stuchlik et al.

(10) Patent No.: US 9,649,003 B2
(45) **Date of Patent: *May 16, 2017**

(54) RANDOM ORBIT DISC SCRUBBER

(71) Applicant: Nilfisk, Inc., Plymouth, MN (US)

(72) Inventors: William Randall Stuchlik, Plymouth, MN (US); Donald Joseph Legatt, St. Michael, MN (US)

(73) Assignee: Nilfisk, Inc., Plymouth, MA (US)

( * ) Notice: Subject to any disclaimer, the term of this patent is extended or adjusted under 35 U.S.C. 154(b) by 96 days.

This patent is subject to a terminal disclaimer.

(21) Appl. No.: 14/623,251

(22) Filed: Feb. 16, 2015

(65) Prior Publication Data

US 2015/0157181 A1 Jun. 11, 2015

Related U.S. Application Data

(63) Continuation of application No. 13/291,510, filed on Nov. 8, 2011.

(60) Provisional application No. 61/411,216, filed on Nov. 8, 2010.

(51) Int. Cl.

| | |
|---|---|
| ***A47L 11/282*** | (2006.01) |
| ***A47L 11/283*** | (2006.01) |
| ***A47L 11/40*** | (2006.01) |
| ***A47L 11/293*** | (2006.01) |

(52) U.S. Cl.

CPC ..... *A47L 11/4038* (2013.01); *A47L 11/283* (2013.01); *A47L 11/293* (2013.01); *A47L 11/4044* (2013.01)

(58) Field of Classification Search

CPC .... A47L 11/282; A47L 11/283; A47L 11/292; A47L 11/293; A47L 11/4038; A47L 11/4044

See application file for complete search history.

(56) References Cited

U.S. PATENT DOCUMENTS

| | | | |
|---|---|---|---|
| 1,472,208 | A | 10/1923 | Dawer |
| 5,287,583 | A | 2/1994 | Lilja |
| 6,585,827 | B2 | 7/2003 | Field et al. |
| 6,705,332 | B2 | 3/2004 | Field et al. |
| 7,025,835 | B2 | 4/2006 | Pedlar et al. |
| 2002/0073494 | A1 | 6/2002 | Stuchlik et al. |

(Continued)

FOREIGN PATENT DOCUMENTS

| | | | |
|---|---|---|---|
| EP | 1841348 | B1 | 5/2009 |
| WO | WO-2012064713 | A1 | 5/2012 |

OTHER PUBLICATIONS

U.S. Appl. No. 13/291,510, Non Final Office Action mailed Aug. 6, 2014, 10 pgs.

(Continued)

*Primary Examiner* — Saeed T Chaudhry

(74) *Attorney, Agent, or Firm* — Schwegman Lundberg & Woessner, P.A.

(57) ABSTRACT

A random orbit scrubber comprises a main body having a front end and a rear end, a squeegee assembly coupled to the rear end of the main body, and a cleaning head assembly coupled to the front end of the main body. The cleaning head assembly can include a cleaning element structured for contact with a floor surface. The cleaning head assembly can further include a motor that is operable to impart rotational and orbital movement on the cleaning element.

20 Claims, 16 Drawing Sheets

(56) References Cited

U.S. PATENT DOCUMENTS

| | | | | |
|---|---|---|---|---|
| 2004/0200017 | A1* | 10/2004 | Crane | A47L 11/4011 15/49.1 |
| 2005/0005389 | A1* | 1/2005 | Rau | A47L 11/201 15/320 |
| 2006/0150362 | A1 | 7/2006 | Mitchell | |
| 2010/0071143 | A1 | 3/2010 | Walker et al. | |
| 2012/0118319 | A1 | 5/2012 | Stuchlik et al. | |

OTHER PUBLICATIONS

U.S. Appl. No. 13/291,510, Notice of Allowance mailed Dec. 5, 2014, 7 pgs.
U.S. Appl. No. 13/291,510, Response filed Oct. 9, 2014 to Non Final Office Action mailed Aug. 6, 2014, 16 pgs.
International Application Serial No. PCT/US2011/059737, International Preliminary Report on Patentability mailed May 23, 2013, 9 pgs.
International Application Serial No. PCT/US2011/059737, Search Report mailed Mar. 5, 2012, 3 pgs.
International Application Serial No. PCT/US2011/059737, Written Opinion mailed Mar. 5, 2012, 7 pgs.

* cited by examiner

RANDOM ORBIT DISC SCRUBBER

CLAIM OF PRIORITY

This patent application is a continuation of and claims the benefit of priority under 35 U.S.C. 120 to U.S. patent application Ser. No. 13/291,510, filed on Nov. 8, 2011, which claims the benefit of priority, under 35 U.S.C. §119(e), to William Randall Stuchlik, U.S. Provisional Patent Application Ser. No. 61/411,216, entitled "RANDOM ORBIT DISC SCRUBBER," filed on Nov. 8, 2010, which are hereby incorporated by reference herein in their entirety.

BACKGROUND OF THE INVENTION

The present application relates generally to a cleaning apparatus. More specifically, the present application relates to a rotary disc scrubber apparatus having random orbital movement.

Rotary disc type scrubbers have been used for decades to clean hard floor surfaces such as tile, linoleum, and concrete. These hard floor surfaces are often uneven which presents challenges to the scrubber and can result in a floor that is not cleaned in a uniform fashion. One approach to cleaning uneven floors is to provide a flexible coupling between the cleaning element and the cleaning head assembly such as a gimbaled pad holder, or scrub brush coupler. The gimbaled design allows some degree of freedom to the brush allowing it to tilt in response to the uneven floor.

Another challenge to conventional floor cleaning is excess water consumption. In the past, it was a widely held belief that the more water that was applied to the floor, the cleaner it could be scrubbed. Within the last few years, this notion has fallen from favor as the floor cleaning industry has become more ecologically conscious. Various approaches have been developed by floor equipment companies using rotary type scrubbers as discussed below.

One approach to the challenge of excess water consumption was developed by the Tennant Company of Minneapolis, Minn. and is disclosed in U.S. Pat. No. 6,585,827, U.S. Pat. No. 6,705,332, and U.S. Pat. No. 6,705,662. Tennant refers to the technology covered by these patents as the FaST™ foam scrubbing technology. Tennant promotional materials represent that this technology increases scrubbing productivity up to 30% for rotary type scrubbers. However, this rotary type scrubber still requires the use of splash skirts to prevent excess water from expelling onto unintended surfaces.

Yet another approach to the challenge of excess water consumption was developed by Windsor Industries of Denver, Colo. and is referred to as the Aqua-Mizer™ technology, which is disclosed in U.S. Pat. No. 7,025,835 entitled "Scrubbing Machine Passive Recycling." Windsor promotional materials represent that this technology increases run-time productivity by 35-50% per tank fill up. However, the rotary type scrubbers that utilize this technology still require the use of splash skirts to prevent excess water from expelling onto unintended surfaces.

A different approach to the challenge of excess water consumption has been developed by Penguin Wax Co. Ltd., of Osaka, Japan. Penguin offers a scrubber called the "Shuttlematic" model numbers SQ 200 and SQ 240. Instead of the rotary motion of the aforementioned floor scrubbers, the Shuttlematic uses two flat pads positioned perpendicular to the direction of travel of the machine. Penguin promotional materials represent that the Shuttlematic has longer run time, less power consumption, and no water splash. The Shuttlematic does not have splash skirts. Another shuttle type design without splash skirts is disclosed in U.S. Pat. No. 1,472,208. The shuttle motion of the '208 Patent is different from the shuttle motion of the Shuttlematic.

Notwithstanding the aforementioned scrubbers, there is still a need for an improved floor cleaning machine that will conserve water without compromising cleaning quality.

SUMMARY OF THE INVENTION

The present application addresses the foregoing needs by providing a floor scrubber machine that can use both rotational and high speed orbital movement to drive a pad driver block attached to a removable cleaning element. Cleaning solution can be dispensed onto the rotating cleaning element through openings in the pad driver or brush block from a dispensing location arranged in a front right and/or a front left (from the operator's position) quadrant as viewed from the top of the pad driver block (with the pad driver block rotating in a counterclockwise or clockwise direction). Dispensing the cleaning solution from the foregoing location(s) can distribute the solution substantially evenly across the surface of the cleaning element.

The combined rotational and orbital movement of the cleaning element can entrap the cleaning solution inside the cleaning element by its small and fast orbiting action and constant velocity directional changes. Because the cleaning solution becomes entrapped within the cleaning element, a lesser amount of cleaning solution can be used as compared to a traditional rotary disc scrubber for the same amount of cleaning. Further, due to the reduction in cleaning solution, the need for a splash skirt can be eliminated.

DETAILED DESCRIPTION OF THE INVENTION

Figure 1:
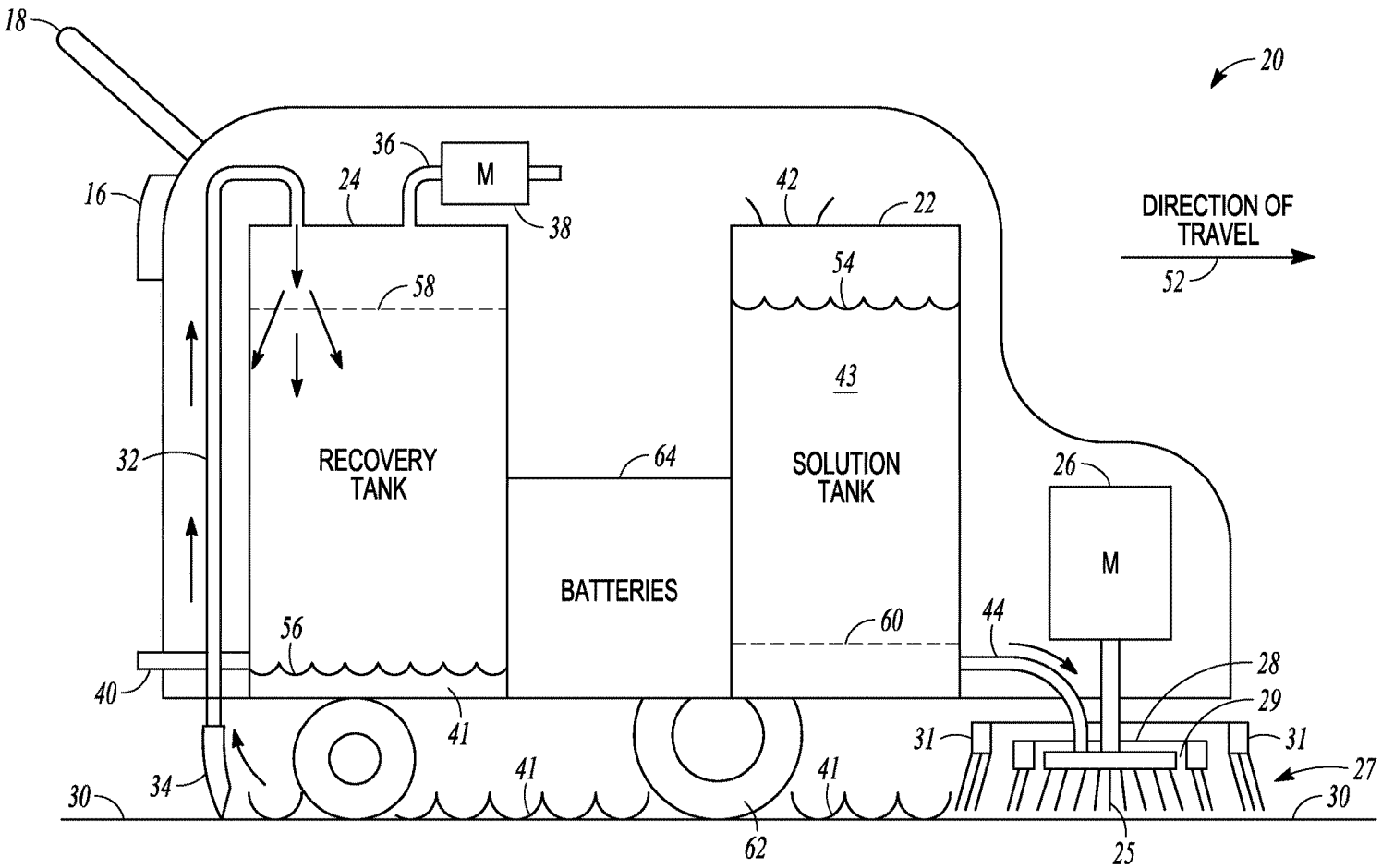
FIG. 1 (PRIOR ART)
FIG. 1 is a schematic view of a prior art rotary motion scrubber.

FIG. 1 is a schematic diagram of a prior art rotary motion type scrubber generally identified by the numeral 20. Particularly, the scrubber 20 uses a cleaning head assembly 27 having a disc shaped cleaning brush 28 that rotates about the shaft of a brush motor 26. Instead of a brush, the cleaning head assembly 27 can utilize a cleaning pad as will be appreciated by those skilled in the art. Scrubbers of this type are generally designed to clean hard floor surfaces such as tile, linoleum, and concrete. These rotary motion scrubbers are typically used in medical facilities, office buildings, educational facilities, restaurants, convenience stores, and grocery stores.

The operator, not shown, walks behind the scrubber 20 and grips the handle 18 to control the direction of travel as indicated by the arrow at the front of the scrubber. A control panel 16 can be positioned at the rear of the scrubber and has various control devices and systems well known to those skilled in the art. The control devices and systems are in electrical connection with the various operating components of the scrubber.

In various examples, there can be an on/off switch and a cleaning head assembly position control device. The cleaning head assembly 27 can include a raised position where the brush 28 is not in contact with the floor surface and a lowered position where the brush 28 is in contact with the floor surface. When the on/off switch is "on" and the cleaning head assembly 27 is placed in the lowered position, a touch down switch can activate the brush motor 26 to scrub the floor.

There can also be a control device to vary the amount of downward load on the cleaning head assembly 27. Some scrubbers have an adjustable actuator that can vary the amount of downward load on the cleaning head assembly 27. Alternatively, scrubbers can have weights on the cleaning head assembly 27 that exert a constant load. For those scrubbers with adjustable load control devices, a heavy load can be used for very dirty floors. Lightly soiled floors require minimum load.

Additional controls can include, but are not limited to, an adjustable flow control device for controllably dispensing the cleaning solution and a squeegee position control device for raising and lowering a squeegee 34.

The rotary motion scrubber 20 can have a solution tank 22 and a recovery tank 24. As illustrated in FIG. 1, the brush motor 26 can drive a disc shaped brush 28 which has bristles 25 that engage the hard surface floor 30. A conduit 32 can connect the squeegee 34 to the recovery tank 24. A conduit 36 can connect the recovery tank 24 with the vacuum motor 38 which can be vented to atmosphere. A drain 40 can be used to drain the dirty fluid 41 from the recovery tank 24.

Concentrated cleaning solution 43 can be poured into the solution tank 22 through the solution tank inlet 42. The cleaning solution 43 can be a liquid and typically includes a mixture of tap water and a cleaning agent such as concentrated floor soap. Generally, the concentrated cleaning agent can be poured into the solution tank 22 and then tap water can be added in the desired amount. The solution tank 22 can be filled with water and concentrated floor soap. When the scrubber is scrubbing, the cleaning solution 43 can pass from the solution tank 22 through the solution conduit 44 to the brush 28. The cleaning solution can then be scrubbed against the floor 30 by the rotating bristles 25 of the brush 28. As the scrubber 20 moves forward as indicated by the arrow 52, the squeegee 34 can suck up the dirty fluid 41 from the floor 30 and the dirty fluid can be directed through the conduit 32 into the recovery tank 24.

As illustrated in FIG. 1 the scrubber 20 has just begun a shift and there is more cleaning solution 43 in the solution tank 22, as indicated by the fluid level line 54, than dirty fluid 41 in the recovery tank, 24 as indicated by the fluid level line 56. However, when the recovery tank 24 is full as indicated by the dashed fluid level line 58, the solution tank 22 will be empty or nearly empty as indicted by the dashed fluid level line 60. When the recovery tank 24 is full as indicated by the fluid level line 58, a float shut off switch turns off the vacuum motor 38. The operator therefore knows it is time to take the scrubber to a janitor's closet or other suitable location to drain the recovery tank 24 through the drain 40. The process can then be repeated. The solution tank 22 can be refilled with a mixture of water and concentrated cleaning solution 43 and the scrubber 20 can be taken back to a work area and can recommence scrubbing the floor 30. The batteries 64 are typically recharged overnight after the job is completed.

Most scrubbers, like the scrubber 20, have traction wheels 62 that can facilitate movement of the scrubber to and from the desired work area. Additionally, some scrubbers have a traction motor to power the traction wheels 62. Scrubbers typically include a power supply to power the brush motor 26, the vacuum motor 38, and if so equipped, the traction motor. In an example, the power supply can comprise at least one 6 or 12-volt DC rechargeable battery. In another example, the power supply can comprise 110 volts AC or 220 volts AC power that is transferred from a wall mounted AC receptacle with a long extension cord.

While scrubbing, cleaning solution 43 can pass through the cleaning solution conduit 44 and feed out by gravity to the top of the brush 28. The brush 28 can have a plurality of holes 29 through the top of the brush that allow some of the cleaning solution 43 to pass through the brush to the bristles 25 and the floor 30. Because the brush 28 is typically rotating between about 175-300 RPM, a substantial amount of the cleaning solution 43 can be expelled from the brush 28 by centrifugal force. Consequently, a splash skirt 31 can be provided that surrounds the brush 28 to contain the cleaning solution that is being expelled therefrom.

Figure 2:
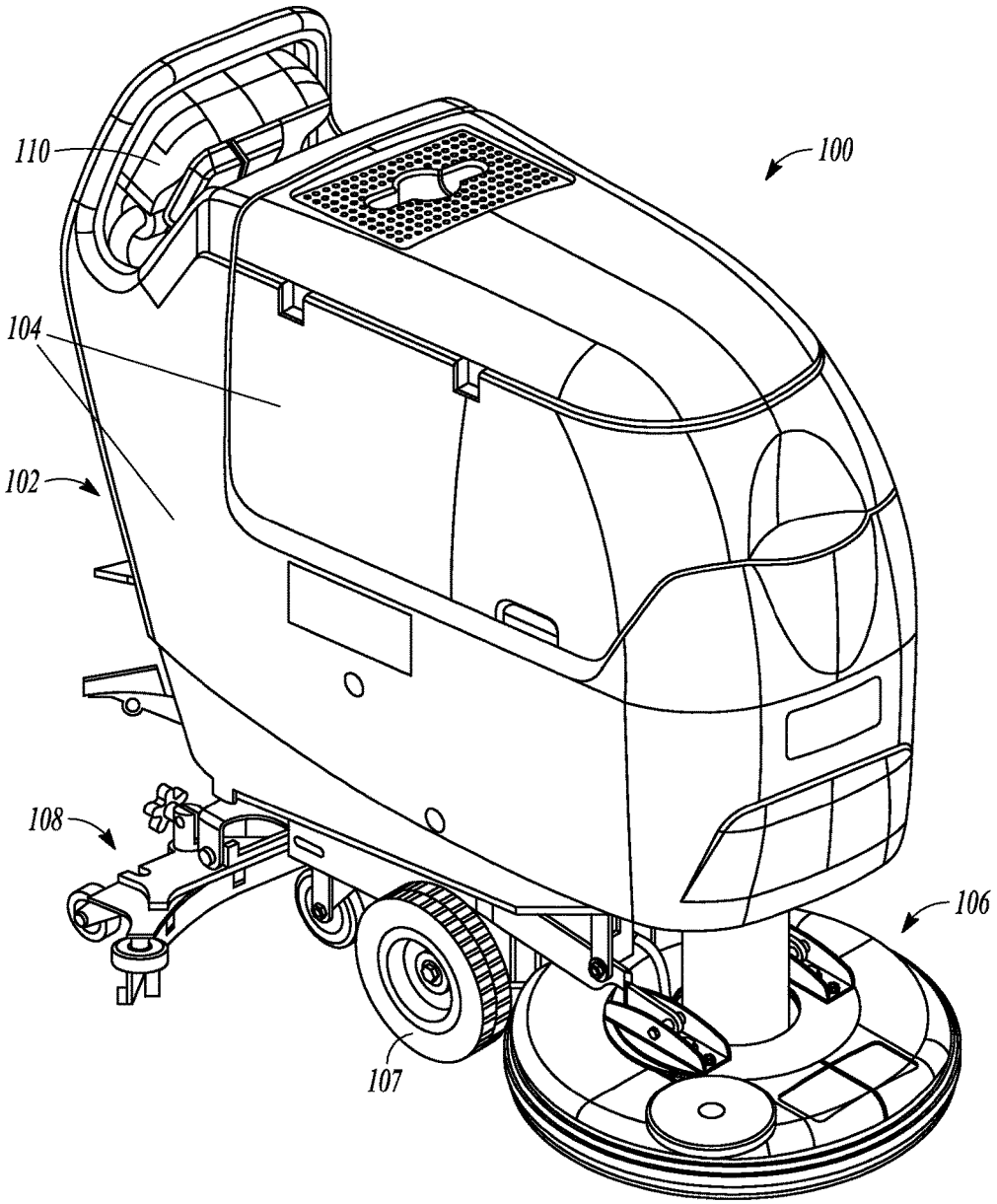
FIG. 2 is a perspective view of an example of a random orbit disc scrubber in accordance with the present application.

FIG. 2 is a perspective view of an example of a random orbit disc scrubber 100 in accordance with the present application. As illustrated in FIG. 2, the random orbit disc scrubber 100 can generally include a main body 102, a compartment 104 containing a solution tank for dispensing a cleaning solution and a recovery tank for recovering the cleaning solution, a random orbit cleaning head assembly 106, a squeegee assembly 108 operably coupled to a vacuum recovery system, and operator controls 110 for controlling movement and operation of the scrubber 100. As will be discussed in further detail to follow, the cleaning head assembly 106 can be operable to distribute the cleaning solution onto a floor surface and to scrub the surface with a suitable pad or brush. Particularly, the cleaning head assembly 106 can impart both rotational and orbital movement on the scrubbing pad or brush, which can result in a more efficient cleaning process that utilizes less cleaning solution as compared to prior art systems without sacrificing cleaning quality. The soiled cleaning solution can be recovered by the squeegee assembly 108 and directed into the recovery tank by the vacuum recovery system. Movement of the scrubber 100 can be initiated by drive wheels 107 that are operable to drive the scrubber 100 during a scrubbing procedure.

Figure 3:
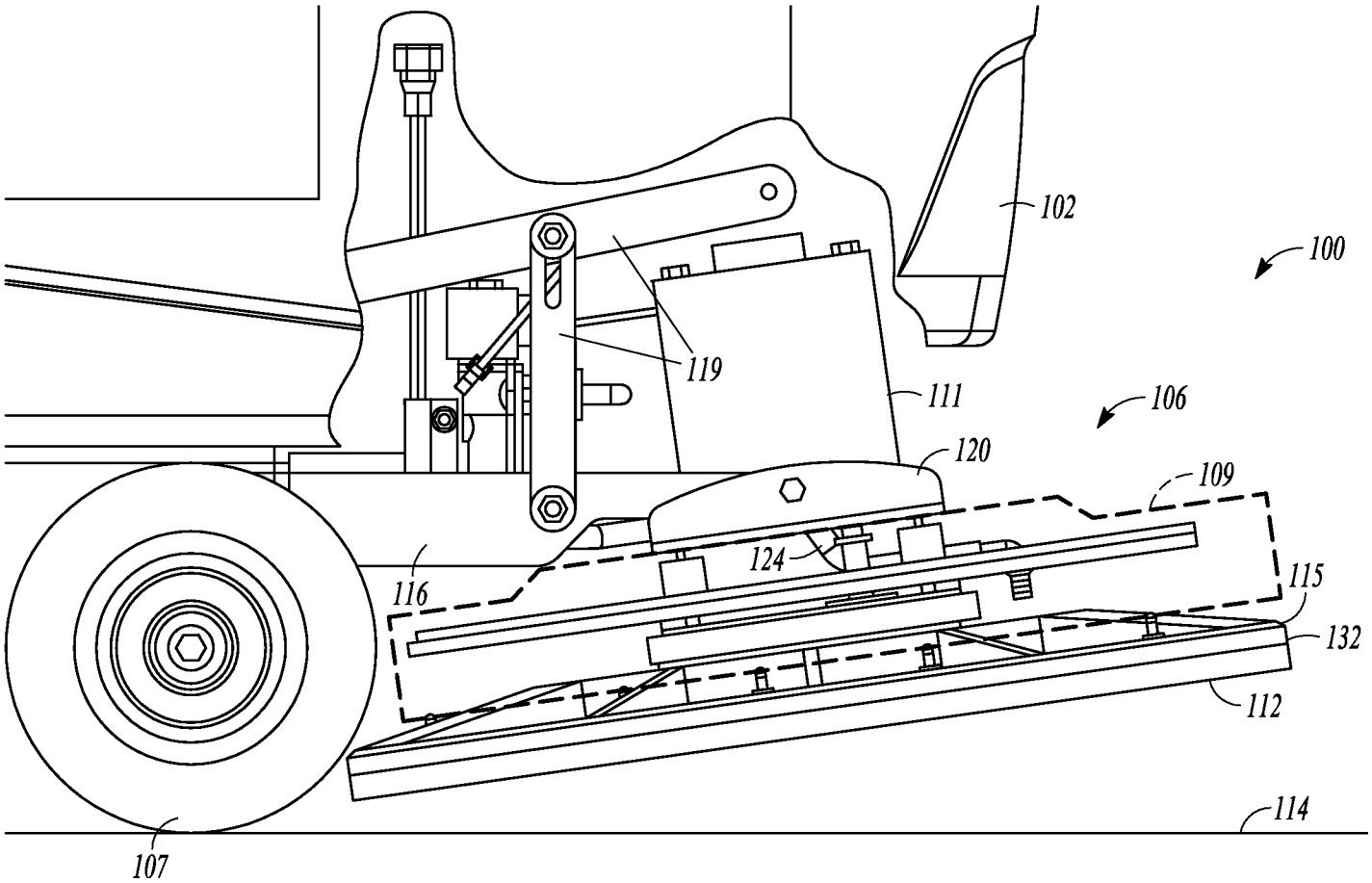
FIG. 3 is a partial side view of the random orbit disc scrubber with a cleaning head assembly in a raised position illustrating various components of the cleaning head assembly.

FIG. 3 is a partial side view of the scrubber 100 with a portion of the main body 102 removed to illustrate various components of the cleaning head assembly 106 and its attachment to the main body 102. A housing 109 of the cleaning head assembly 106 is also shown in broken lines to allow visualization of the cleaning head assembly components. As illustrated in FIG. 3, the cleaning head assembly 106 can include a motor 111 that imparts both rotational and orbital movement on a suitable cleaning element 112 that can be structured for contact with a floor surface 114. Particularly, the rotational and orbital movement can be transferred to the cleaning element 112 via a rotatable and orbitable pad driver block 115 that can be driven by the motor 111 as will be discussed in further detail to follow.

As used herein, the term "cleaning element" includes cleaning pads, cleaning brushes, and the like. The cleaning element can be both removable and flexible, such as a flexible cleaning pad. Although any suitable cleaning pad can be used as the cleaning element 112, exemplary cleaning pads can include the high productivity pad 7300, the black stripper pad 7200, the eraser pad 3600, the red buffer pad 5100, and the white super polish pad 4100 sold by 3M Company of St. Paul, Minn.

Figure 4:
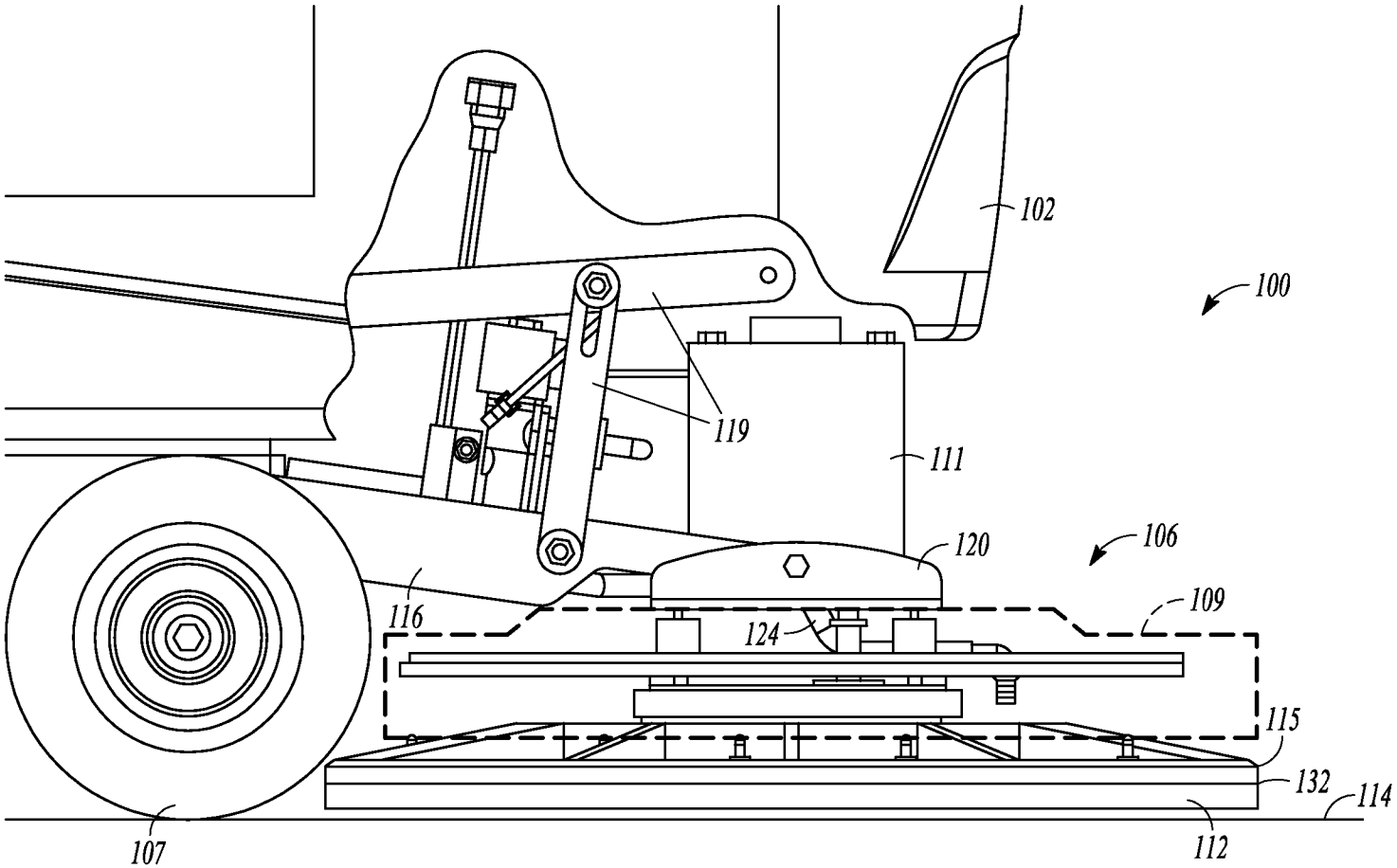
FIG. 4 is a partial side view of the random orbit disc scrubber with the cleaning head assembly in a lowered position.
Figure 6:
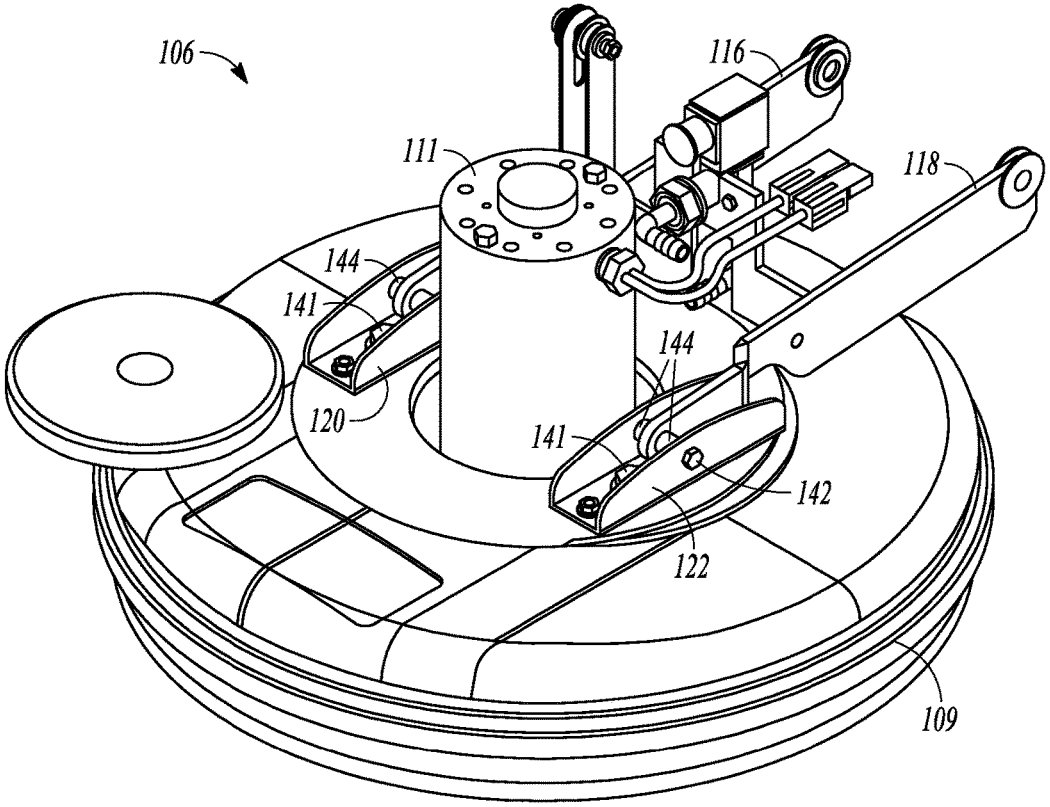
FIG. 6 is a perspective view of the cleaning head assembly isolated from the remainder of the machine.

The random orbit disc scrubber 100 can include a right lift arm 116 and a left lift arm 118 that pivotally engage a right lift bracket 120 and a left lift bracket 122 (as better illustrated in FIG. 6). The right and left lift arms 116 and 118 can be operable to move the cleaning head assembly 106 between a raised position, as shown in FIG. 3, and a lowered position, as shown in FIG. 4. As appreciated by those skilled in the art, the cleaning head assembly 106 can be placed in the raised position of FIG. 3 when the scrubber 100 is not in use or is being driven to the cleaning location and the lowered position of FIG. 4 for engaging and scrubbing the floor surface 114.

The right and left lift arms 116 and 118 can be configured to raise and lower the cleaning head assembly 106 between the positions illustrated in FIGS. 3 and 4 in response to a user-operated actuator. In an example, a foot pedal located at the rear of the scrubber 100 can be actuated to raise and lower the cleaning head assembly 106 via a right linkage assembly 119. In an example, a left linkage assembly (not shown) can also be used. However, any suitable raising and lowering mechanism can be employed.

As illustrated in FIG. 3, a solution conduit 124 can run from the solution tank (not shown) to a solution dispenser 126 positioned near the front side of the cleaning head assembly 106 for controllably dispensing the cleaning solution onto the cleaning element 112 and the floor surface 114. In an example, the cleaning solution runs by gravity from the solution tank through the solution conduit 124 to the solution dispenser 126 where it drips through the pad driver block 115 and onto the rotating cleaning element 112. In a further example, the cleaning solution can be pumped to the rotating cleaning element 112.

From time to time, cleaning elements wear out or become damaged and thus need to be replaced. Additionally, it may be necessary to change the type of cleaning element to better suit a particular cleaning application, such as by replacing a cleaning pad with a cleaning brush. In an example, the cleaning elements 112 can be removed and installed without the use of tools thus making it easy to replace a cleaning element. As illustrated in FIG. 3, the cleaning element 112 can be removably coupled to the pad driver block 115 with an attachment means 132. For example, the attachment means 132 can comprise a hook and loop type attachment means. However, any suitable attachment means that can removably and securely hold the cleaning element 112 to the pad driver block 115 can be used including, but not limited to, an adhesive, snap members, latches, threaded fasteners, or the like. As will be appreciated by those skilled in the art, the attachment means 132 can be formed as a separate component from the pad driver block 115 or integral with the pad driver block 115 without departing from the intended scope of the present application. Forming the attachment means 132 separate from or integral with the pad driver block 115 is merely a matter of design choice.

Figure 5:
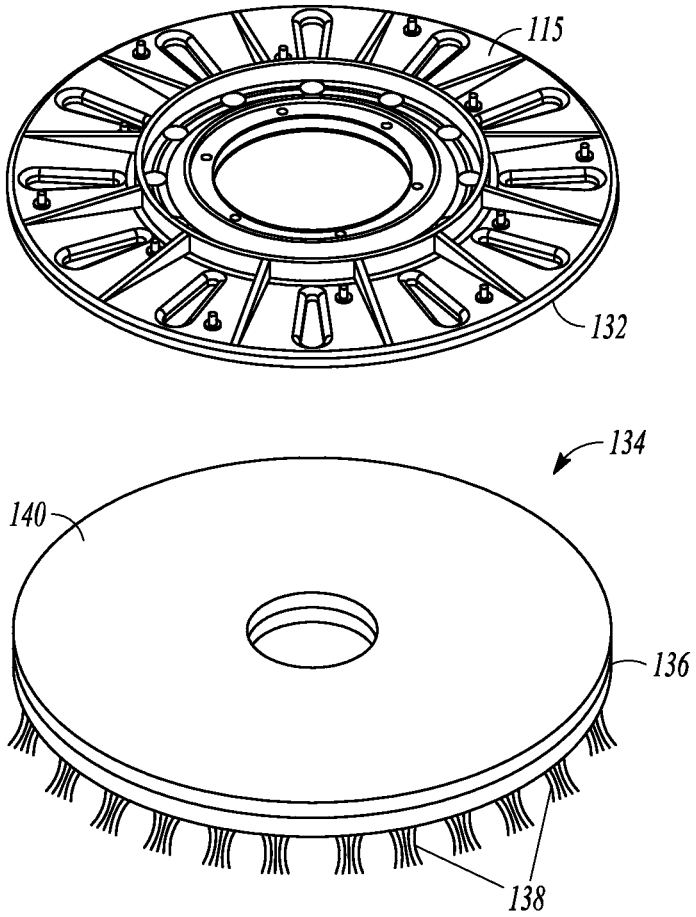
FIG. 5 is a perspective view of a pad driver block and a removable cleaning element.

As discussed above, the cleaning element 112 can take on numerous forms including a cleaning pad and a cleaning brush. FIG. 5 is a perspective view of the pad driver block 115 and one such removable cleaning brush 134. As illustrated in FIG. 5, the pad driver block 115 includes the attachment means 132, which can be a hook and loop type fastener or other suitable device. The removable cleaning brush 134 can include a flexible sheet 136 with bristles 138 extending from one side and a pad 140 located on the opposite side. The flexible sheet 136 can be formed from any suitable material, such as plastic or nylon. In alternative embodiments, the sheet 136 can be rigid rather than flexible. The pad 140 can be structured to removably engage the attachment means 132 on the pad driver block 115.

FIG. 6 is a perspective view of the cleaning head assembly 106 isolated from the remainder of the scrubber 100. As illustrated in FIG. 6, the right and left lift brackets 120 and 122 can be coupled to the housing 109 of the cleaning head assembly 106 in any suitable manner, such as with one or more fasteners 141. As further illustrated in FIG. 6, the right and left lift arms 116 and 118 can be hingedly coupled to the right and left lift brackets 120 and 122, respectively, with a suitable pin or bolt 142. Lateral movement of the right and left lift arms 116 and 118 at the hinged connection point can be prevented or minimized by the placement of spacers 144 on one or both sides of the lift arms. Together, the right and left lift arms 116 and 118 can raise and lower the cleaning head assembly 106 from the lower scrubbing position of FIG. 4 to the upper position of FIG. 3 as previously discussed.

Figure 7:
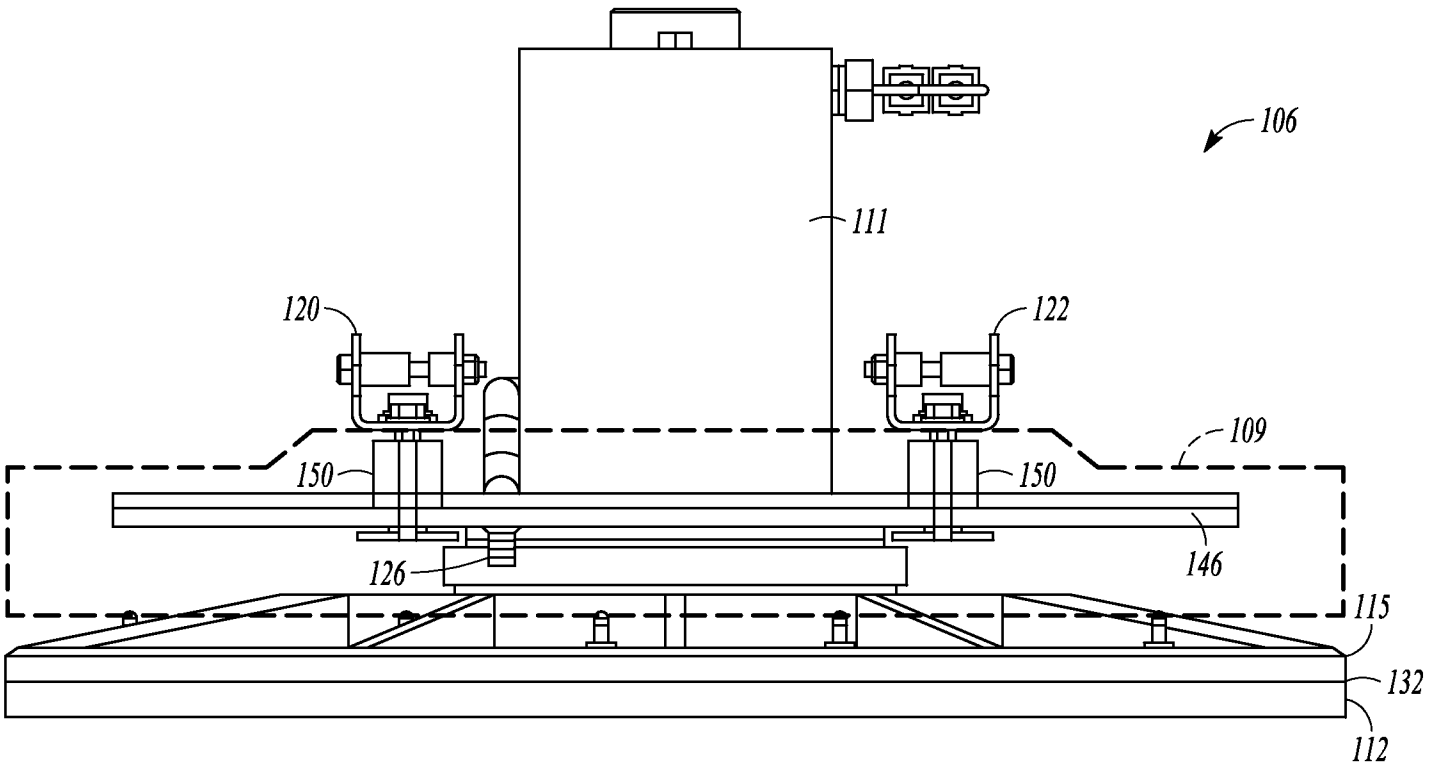
FIG. 7 is a front view of the cleaning head assembly.

FIG. 7 is a front view of the cleaning head assembly 106 isolated from the remainder of the scrubber 100 to better show the components of the cleaning head assembly 106. Once again, the housing 109 of the cleaning head assembly 106 is shown in broken lines to allow visualization of the various cleaning head components. As illustrated in FIG. 7, the motor 111 can be mounted on a motor mounting plate 146. Prior art rotary motion scrubbers such as that illustrated in FIG. 1 typically utilize cleaning elements that rotate about the centerline of the motor driveshaft. This produces purely rotational movement of the cleaning element. However, the random orbit disc scrubber 100 of the present application provides a cleaning element 112 that can rotate and orbit about the centerline of the drives haft of the motor 111.

Figure 9:
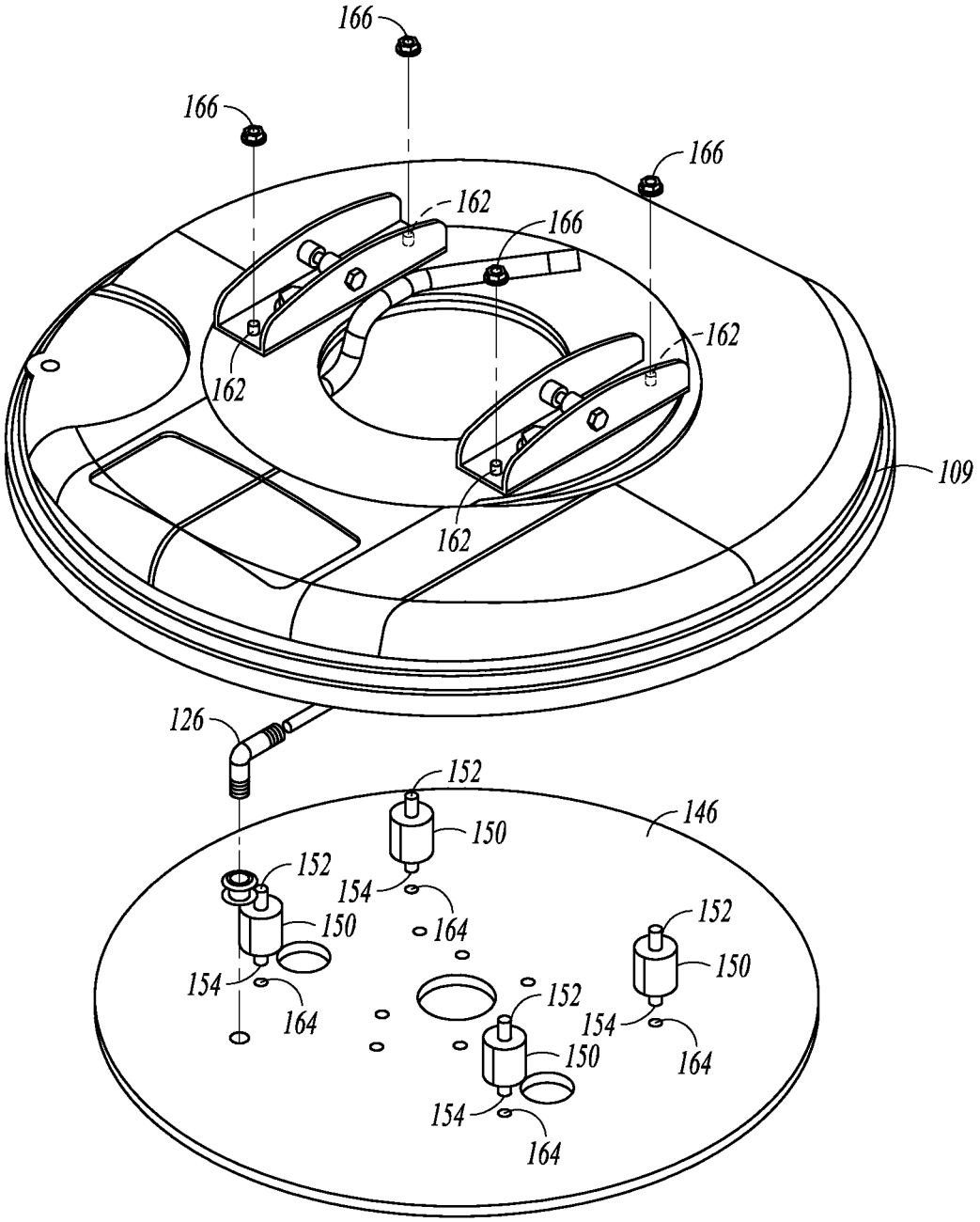
FIG. 9 is an exploded perspective view of selected components of the cleaning head assembly illustrating exemplary positioning and connection of the vibration dampening elements.

As will be described in further detail with reference to the following figures, the orbital movement can be imparted to the cleaning element 112 by an eccentric cam operably coupled to the driveshaft of the motor 111. The cleaning element 112 can orbit at speeds exceeding 2000 revolutions per minute, which induces vibrations in the cleaning head assembly 106. In order to enhance the life of the scrubber 100, these vibrations are preferably dampened. To that end, as illustrated in FIG. 7, a plurality of vibration dampening elements 150 can be positioned between the motor mounting plate 146 and the right and left lift brackets 120 and 122. As best illustrated in FIG. 9, four vibration dampening elements 150 can be disposed between each of the lift brackets 120 and 122 and the motor mounting plate 146. Because the pad driver block 115 and the cleaning element 112 are structured to rotate independent of the orbital movement, vibration dampening is provided only in the "upper" region of the cleaning head assembly 106 between the lift brackets 120 and 122 and the motor mounting plate 146 and not in the "lower" region of the cleaning head assembly 106 between the motor mounting plate 146 and the pad driver block 115.

Figure 8:
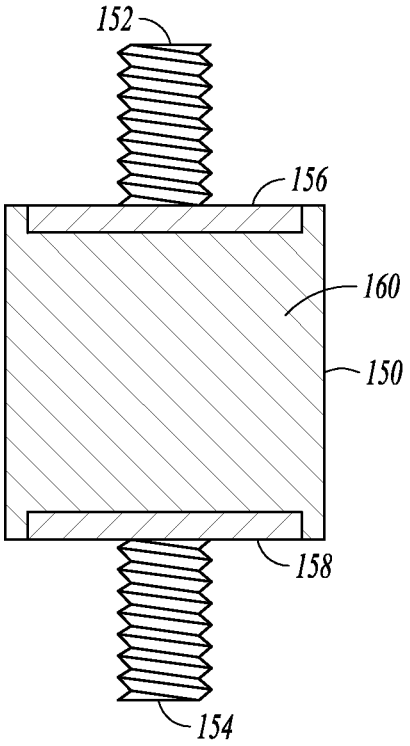
FIG. 8 is a cross-sectional view of an exemplary vibration dampening element that can be used in the cleaning head assembly.

FIG. 8 is a cross-sectional view of one of the vibration dampening elements 150 of FIG. 7. As illustrated in FIG. 8, the vibration dampening element 150 can include an upper threaded shaft 152 and a lower threaded shaft 154. The upper threaded shaft 152 can extend from an upper support plate 156 and the lower threaded shaft 154 can extend from a lower support plate 158. The body 160 of the vibration dampening element 150 can be formed from any suitable material, such as a natural rubber with a durometer of about 40. However, numerous other ratings are also possible. Additionally, various man-made elastomers can also be suitable for the vibration dampening elements 150. Other types of vibration dampening elements can also be suitable as long as they are deformable or have some degree of flexibility to allow dampening of the vibrations. For example, metal springs can be used in place of a natural rubber or man-made elastomer material to dampen the system vibrations during operation.

FIG. 9 is an exploded perspective view of the housing 109, right and left lift brackets 120 and 122, and the motor mounting plate 146 further illustrating the positioning and connection of the vibration dampening elements 150. Particularly, as illustrated in FIG. 9, the upper threaded shaft 152 of each of the vibration dampening elements 150 can be structured to be received within a corresponding aperture in the housing 109 (not shown) and an aperture 162 in the right and left lift brackets 120 and 122. Similarly, the lower threaded shaft 154 of each of the vibration dampening elements 150 can be structured to be received within a corresponding aperture 164 in the motor mounting plate 146. The upper threaded shafts 152 can be secured to the right and left lift brackets 120 and 122 with any suitable fastening means, such as with a corresponding plurality of internally threaded nuts 166 that are structured to threadably engage the upper threaded shafts 152. Although not shown, a similar type of fastening means can be used to secure the lower threaded shafts 154 to the motor mounting plate 146. Furthermore, although threaded shafts and nuts are described as the dampening element fastening means, those skilled in the art will appreciate that any suitable means of fastening the vibration dampening elements 150 between the lift brackets 120 and 122 and the motor mounting plate 146 can be used without departing from the intended scope of the present application.

As will be appreciated by those skilled in the art in view of the foregoing, the vibration dampening elements 150 can reduce sound and vibration between the motor mounting plate 146, the housing 109, and the right and left lift brackets 120 and 122. Additionally, the vibration dampening elements 150 can also allow the cleaning head assembly 106 to move and conform to variations in floor elevation relative to the machine body. This prevents uneven loading of the cleaning head assembly 106 which would otherwise result in increased vibration. The ability of the cleaning head assembly 106 to conform to variations in floor elevation can also result in a more uniform cleaning of the floor surface.

While the structure and positioning of exemplary vibration dampening elements 150 has been described in detail, those skilled in the art will appreciate that the number, location, and type of vibration dampening elements can vary according to the size of the motor 111, the size of the cleaning element 112, and the size of the pad driver block 115, among other factors.

Figure 10:
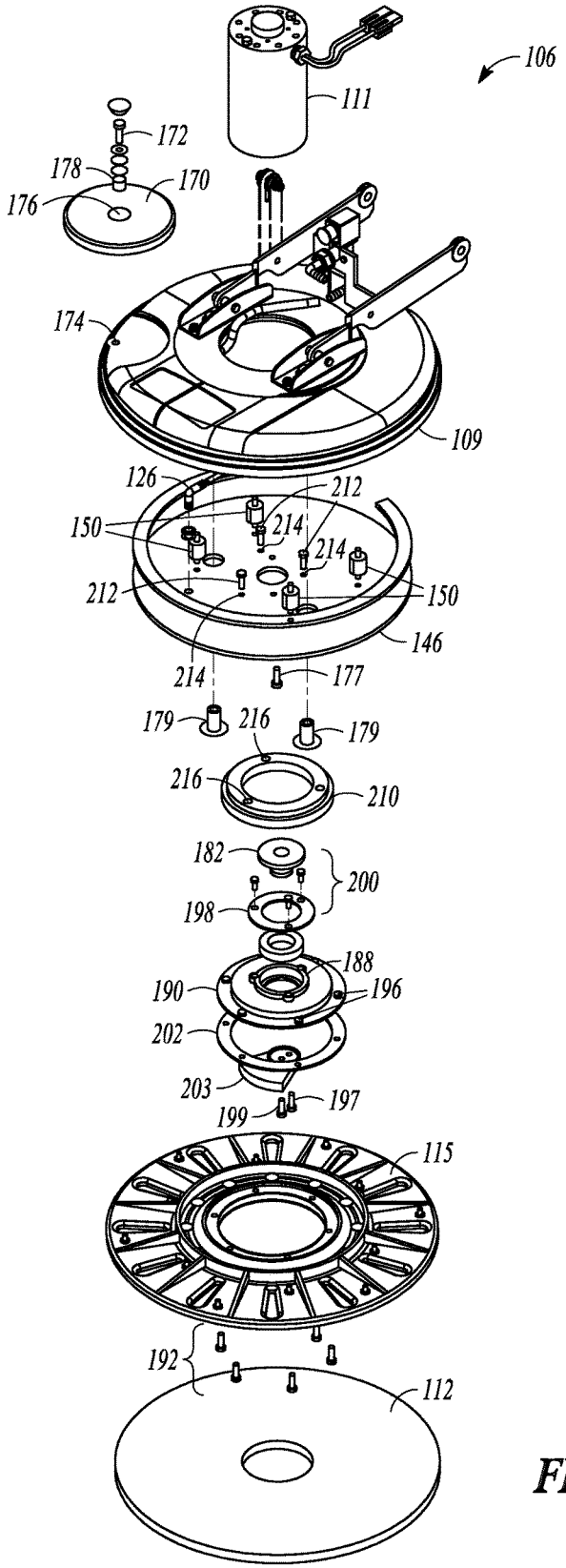
FIG. 10 is an exploded perspective view of the entire cleaning head assembly.
Figure 11:
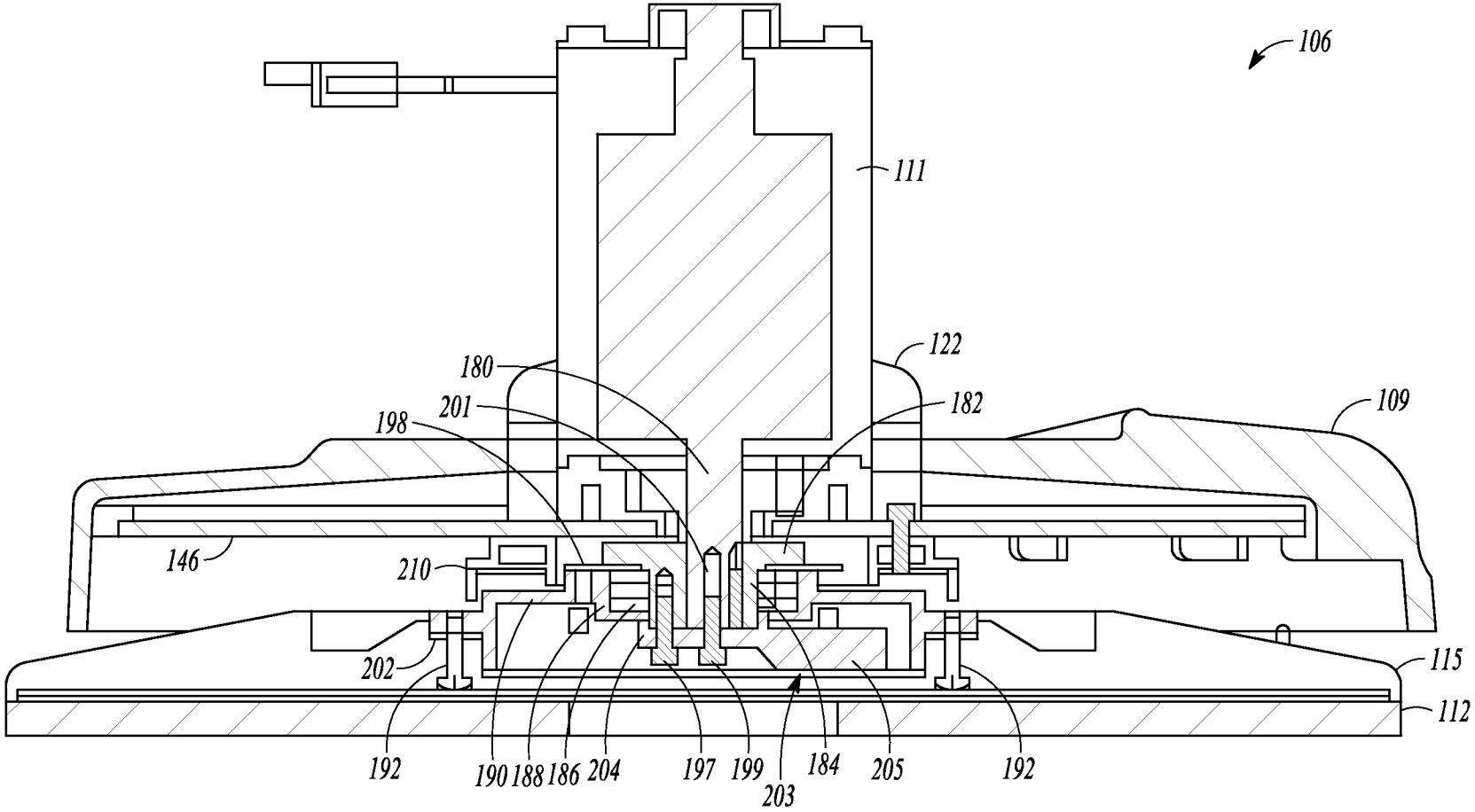
FIG. 11 is a side cross-sectional view of the cleaning head assembly.

FIG. 10 is an exploded perspective view of the cleaning head assembly 106, while FIG. 11 is a side cross-sectional view of the cleaning head assembly 106. Together, the exploded view of FIG. 10 and the cross-sectional view of FIG. 11 illustrate the structure and function of the various cleaning head assembly components.

As will be appreciated by those skilled in the art, the motor mounting plate 146 and the housing 109 remain stationary relative to the motor 111 during a scrubbing procedure. Particularly, the motor mounting plate 146 can be fixedly coupled to the motor 111 in any suitable manner, such as with a plurality of threaded fasteners 177 (only one shown in FIG. 10) structured to be received within a corresponding plurality of threaded apertures in the motor 111. Similarly, the motor mounting plate 146 can be fixedly coupled to the housing 109 in any suitable manner, such as with a plurality of bolts 179.

The motor 111 can be operable to cause a drive shaft 180 to rotate. The drive shaft 180 can be structured for mounting off-center in an eccentric cam 182, as best illustrated in FIG. 11. An extension shaft 184 extends from and can be integral with the eccentric cam 182. A suitable bearing assembly 186 can be press-fit into a journal 188 of a motor driver plate 190, which in turn can coupled to the pad driver block 115 with a plurality of fasteners 192 structured to pass through a plurality of apertures 194 along an inner radius of the pad driver block 115 and a corresponding plurality of apertures 196 along an outer radius of the motor driver plate 190. A retaining ring 198 can be fastened to a top side of the motor driver plate 190 with a plurality of fasteners 200 to retain the bearing assembly 186 within the journal 188 of the motor driver plate 190. Optionally, a suitable gasket 202 can be fastened between the pad driver block 115 and the motor driver plate 190 to help prevent cleaning solution from entering into the pad driver block 115, dampen vibrations, and provide a secure connection.

When assembled as illustrated in FIG. 11, the extension shaft 184 of the eccentric cam 182 can be structured to contact the internal raceway of the bearing assembly 186. A bolt 199 can threadably engage an aperture 201 in the drive shaft 180 of the motor 111. When the motor 111 is "on" the drive shaft 180 can rotate the eccentric cam 182 which imparts orbital movement to the pad driver block 115 due to the off-center position of the drive shaft 180 in the eccentric cam 182. Stated alternatively, the longitudinal center axis of the drive shaft 180 and the longitudinal center axis of the extension shaft 184 of the eccentric cam 182 are not in alignment which imparts the orbital movement on the pad driver block 115. In an example, the longitudinal center axis of the drive shaft 180 can be "off-centered" from the longitudinal center axis of the extension shaft 184 by an amount equal to about ⅛", thereby producing small orbits of about ¼" in diameter. However, the ⅛" offset is presented merely for purposes of example and not limitation. Thus, any suitable offset can be used to produce orbital movement of the pad driver block 115 and the cleaning element 112 as will be appreciated by those skilled in the art.

As discussed above, the pad driver block 115 can be fixedly coupled to the motor driver plate 190, which can be rotatable relative to the eccentric cam 182 due to the presence of the bearing assembly 186 in the driver plate journal 188. Thus, the pad driver block 115 and attached cleaning element 112 also rotate independently of the orbital movement provided by the offset in the eccentric cam 182. In an example, rotation of the drive shaft 180 at a speed of about 2200 revolutions per minute can produce circumferential rotation of the pad driver block 115 and attached cleaning element 112 at a speed of about 30 revolutions per minute. This additional circumferential rotation can provide better distribution of the cleaning solution, better cleaning action (especially with a brush application), and improved debris deflection as compared to a purely orbitable cleaning element. As those skilled in the art will appreciate, debris would have more of a tendency to build-up on the non-rotating edge of a purely orbitable cleaning element.

The rotational speed of the pad driver block 115 and cleaning element 112 can be significantly slower than a conventional prior art rotary disc scrubber such as that illustrated in FIG. 1, which can rotate at a speed between about 175-300 revolutions per minute. Such conventional rotary disc scrubber machines tend to expel cleaning solution several inches past the perimeter of the cleaning element thereby requiring skirts (such as splash skirt 31 of FIG. 1) around the scrubber deck to prevent solution from splashing onto baseboards and extending beyond the reach of the squeegee. The amount of cleaning solution expelled by the cleaning head assembly 106 of the present application is insignificant due to the slower circumferential rotation of the pad driver block 115 and cleaning element 112, thus making a splash skirt unnecessary.

As will be appreciated by those skilled in the art, rotating the pad driver block 115 at high speeds to produce the desired orbital movement generates a centripetal force that must be counteracted in order to provide a balanced rotation. Thus, as illustrated in FIGS. 10 and 11, a counterweight 203 can be provided that includes a connection sleeve 204 structured to receive a bottom portion of the extension shaft 184 of the eccentric cam 182 and a main body 205 that provides a region of concentrated mass. The counterweight 203 can be fastened to the drive shaft 180 of the motor 111 with the bolt 199. A second bolt 197 can be provided to fasten the counterweight 203 to the eccentric cam 182. Consequently, the drive shaft 180, the eccentric cam 182, and the counterweight 203 move together in unison.

The counterweight 203 acts as the balancing force to the centripetal force generated by the pad driver block 115. Particularly, the main body 205 of the counterweight 203 can act in a direction that is directly opposite and generally inline with the force being generated by the pad driver block 115. In other words, the center of mass of the counterweight 203 can be positioned such that it is generally inline with the center of mass of the pad driver block 115. Any significant offset between these two lines of forces would generate a torque or couple on the drive shaft 180, thus creating vibration in the system. As further illustrated in FIG. 11, the cleaning head assembly 106 can be designed with the counterweight 203 located inside the pad driver block 115 in order to reduce the torque on the drive shaft 180 and the scrubber 100 as a whole. Placing the counterweight at another location, such as above the pad driver block 115 and the eccentric cam 182, would generate a moment on the system and result in undesirable loading.

A stationary splash shield 210 can be fixedly coupled to the motor mounting plate 146 with a plurality of fasteners 212 that extend through a plurality of apertures 214 in the motor mounting plate 146 and a corresponding plurality of apertures 216 in a top side of the splash shield 210. As will be appreciated by those skilled in the art, the splash shield 210 can be sized such that it encloses the distal end of the drive shaft 180, the eccentric cam 182, and the bearing assembly 184 to prevent cleaning solution from coming into contact with these components during operation.

In order to protect the cleaning head assembly 106 and to avoid damage to walls and furniture, the cleaning head assembly 106 can be equipped with one or more roller bumpers 170. As best illustrated in FIG. 10, the roller bumper 170 can be secured to the housing 109 with a bolt 172 that passes through an aperture 174 in the housing 109 and an aperture 176 in the center of the roller bumper 170. A nut 178 can be provided that threads onto the extended portion of the bolt 172 to secure the roller bumper 170 to the housing 109 while at the same time allowing the roller bumper 170 to freely rotate about the bolt 172. The roller bumper 170 can be sized to extend beyond the housing 109, as better seen in FIG. 6, such that it can bump and rotate against walls, furniture, and other fixtures so as to protect the cleaning head assembly 106. Additionally, the roller bumper 170 can help to prevent scrapes and scratches on walls and other fixtures when the cleaning head assembly 106 inadvertently contacts a wall or fixture.

Figure 12:
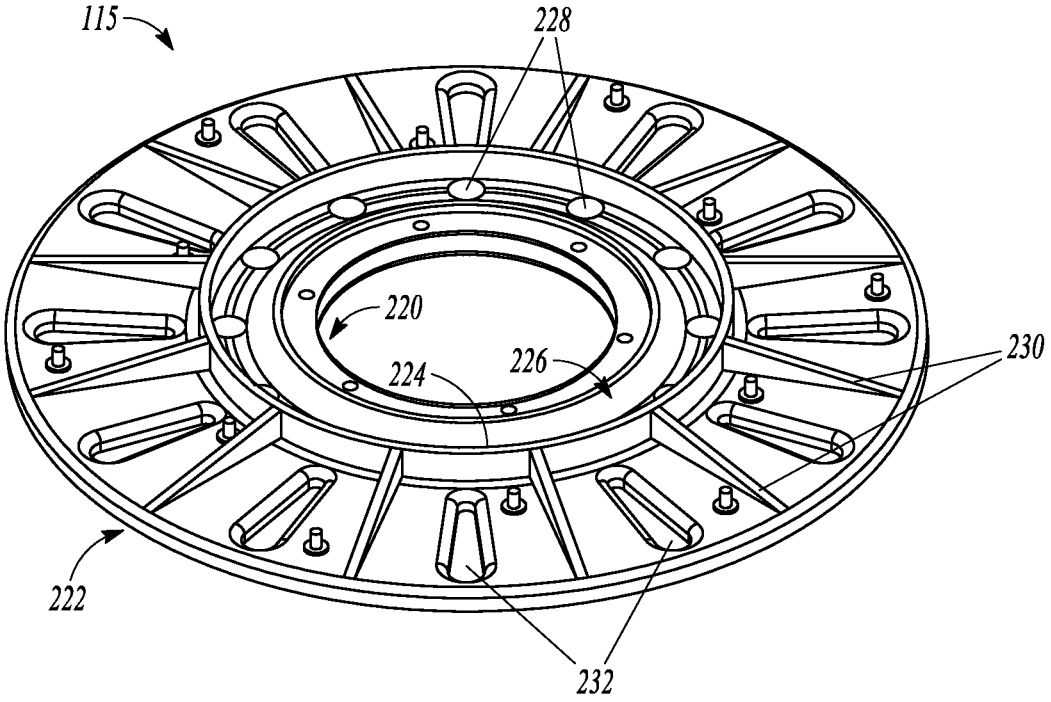
FIG. 12 is a perspective view of the pad driver block illustrating various design features of the block.

FIG. 12 is a perspective view of the pad driver block 115 illustrating various design features of the block. As illustrated in FIG. 12, the pad driver block 115 can include an inner region 220 and an outer region 222 separated by a circumferential ridge 224. The inner region 220 defines a trough 226 having a plurality of apertures 228 for dispensing the cleaning solution to the cleaning element 112. Particularly, cleaning solution can be delivered through the solution conduit 124 and the solution dispenser 126 to the trough 226 where it can be funneled through the apertures 228 and onto the rotating cleaning element 112. A total of 12 apertures 228 are illustrated, although the pad driver block 115 can have any number of apertures without departing from the intended scope of the application.

As illustrated in FIG. 12, the outer region 222 of the pad driver block 115 includes a plurality of circumferentially spaced ribs 230 that are structured to provide rigidity to the pad driver block 115. As further illustrated in FIG. 12, the outer region 222 can include a plurality of suitably sized slots 232 for reducing the weight of the pad driver block 115. Those skilled in the art will appreciate that reducing the weight of the pad driver block 115 can correspondingly reduce the size of the counterweight that is required to balance the various forces in the system.

Figure 13:
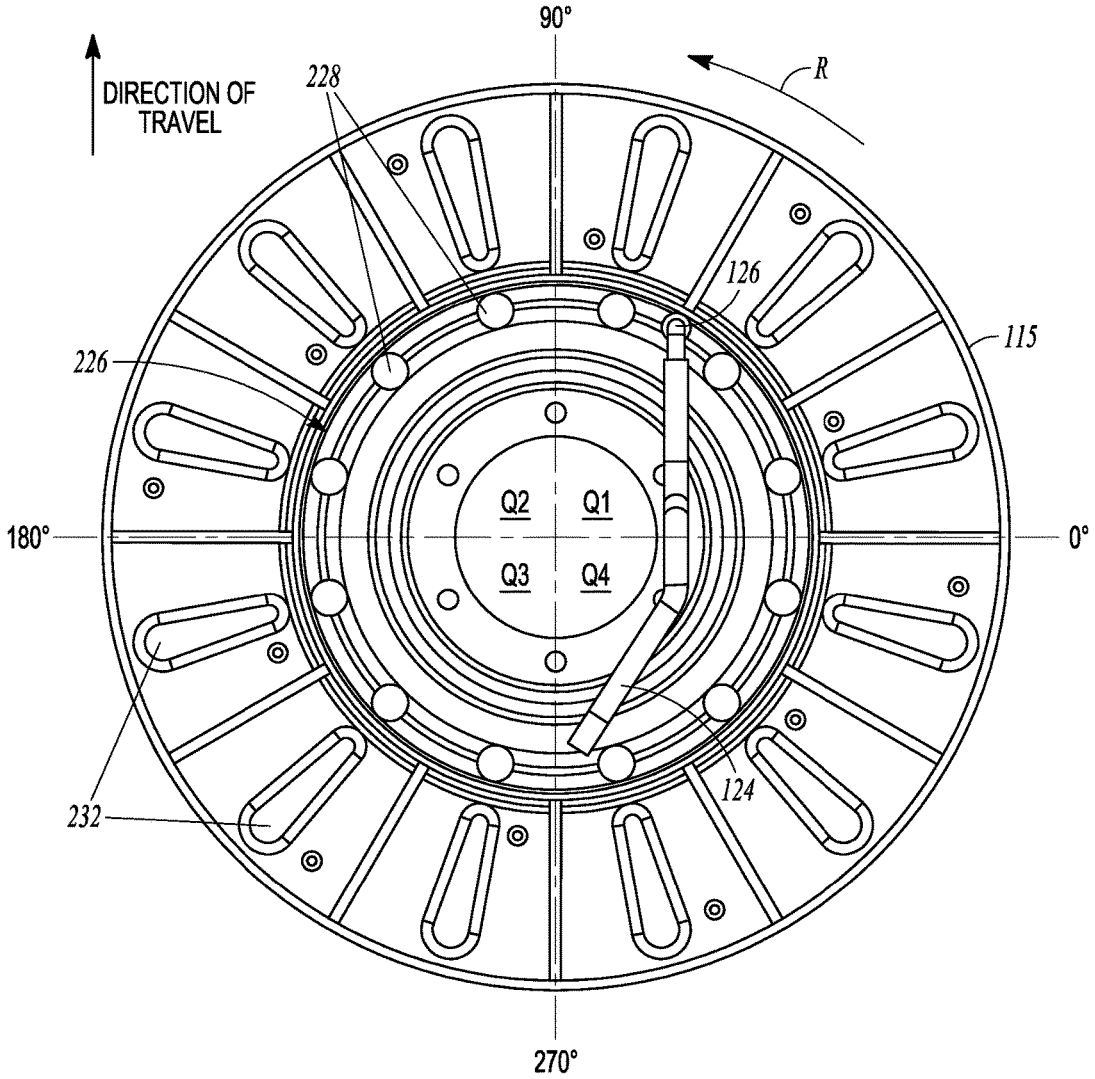
FIG. 13 is a diagram illustrating a top view of the pad driver block showing an example of a dispensing location for the cleaning solution.

FIG. 13 is a diagram illustrating a top view of the pad driver block 115 showing the dispensing location of the cleaning solution from the solution dispenser 126. Particularly, it is assumed that the direction of travel is oriented toward the top of the page as shown, and the direction of rotation R of the pad driver block 115 is counterclockwise. In order to more clearly describe the dispensing location, the diagram has been divided into four quadrants including a first quadrant Q1 (i.e., 0-90 degrees), a second quadrant Q2 (i.e., 90-180 degrees), a third quadrant Q3 (i.e., 180-270 degrees), and a fourth quadrant Q4 (i.e., 270-360 degrees). Alternatively, the first quadrant Q1 can be described as the front right quadrant as viewed from the top of the pad driver block 115, the second quadrant Q2 can be described as the front left quadrant as viewed from the top of the pad driver block 115, the third quadrant Q3 can be described as the back left quadrant as viewed from the top of the pad driver block 115, and the fourth quadrant Q4 can be described as the back right quadrant as viewed from the top of the pad driver block 115. Right corresponds to the right hand side of the machine as viewed from the operator position and front corresponds to the direction of travel during cleaning.

In the example of FIG. 13, the dispensing location can be in the first or front right quadrant Q1 as viewed from the top of the pad driver block 115 when the block is rotating in the counterclockwise direction. Particularly, it has been found that dispensing the cleaning solution from the solution dispenser 126 in the first or front right quadrant Q1 can distribute the cleaning solution across substantially the full area of the cleaning element 112 without expelling any significant amount of solution outside of the cleaning head assembly 106. Thus, positioning the solution dispenser 126 in the proper location can be instrumental in operating the scrubber 100 in the most efficient manner and minimizing the amount of cleaning solution that is necessary in order to clean a desired floor surface.

As will be appreciated by those skilled in the art, if the direction of rotation R of the pad driver block 115 is reversed such that the block rotates clockwise, the FIG. 13 dispensing location would then be in the second or front left quadrant Q2 as viewed from the top of the pad driver block 115.

In operation, the cleaning solution can be pumped to the pad driver block 115 and the cleaning element 112 via a suitable fluid pump that can be controlled by the operator controls 110. The pump can be controlled to provide the correct proportional amount of water to chemical as directed by the operator. In an example, the cleaning solution can be gravity fed to the rotating pad driver block 115, such as by allowing the cleaning solution to drip into the trough 226. In another example, the solution dispenser 126 can include a modulated valve that is operable between an "on" position and an "off" position at suitable intervals. Regardless of the manner in which the cleaning solution is dispensed onto the pad driver block 115, the cleaning solution can be substantially evenly distributed across the cleaning element 112 as described above.

As will be appreciated by those skilled in the art based on the foregoing, the rotational and orbital movement of the cleaning element 112 can entrap the cleaning solution inside the cleaning element by its small and fast orbiting action and constant velocity directional changes. Because the cleaning solution is entrapped within the cleaning element 112, approximately ½ the amount of cleaning solution can be required as compared to a traditional rotary disc scrubber for the same amount of cleaning. The combined rotational and orbital movement of the cleaning element 112 can also produce a more uniform scrub pattern without the "swirls" that are often produced by traditional rotary disc scrubbers.

Figure 14:
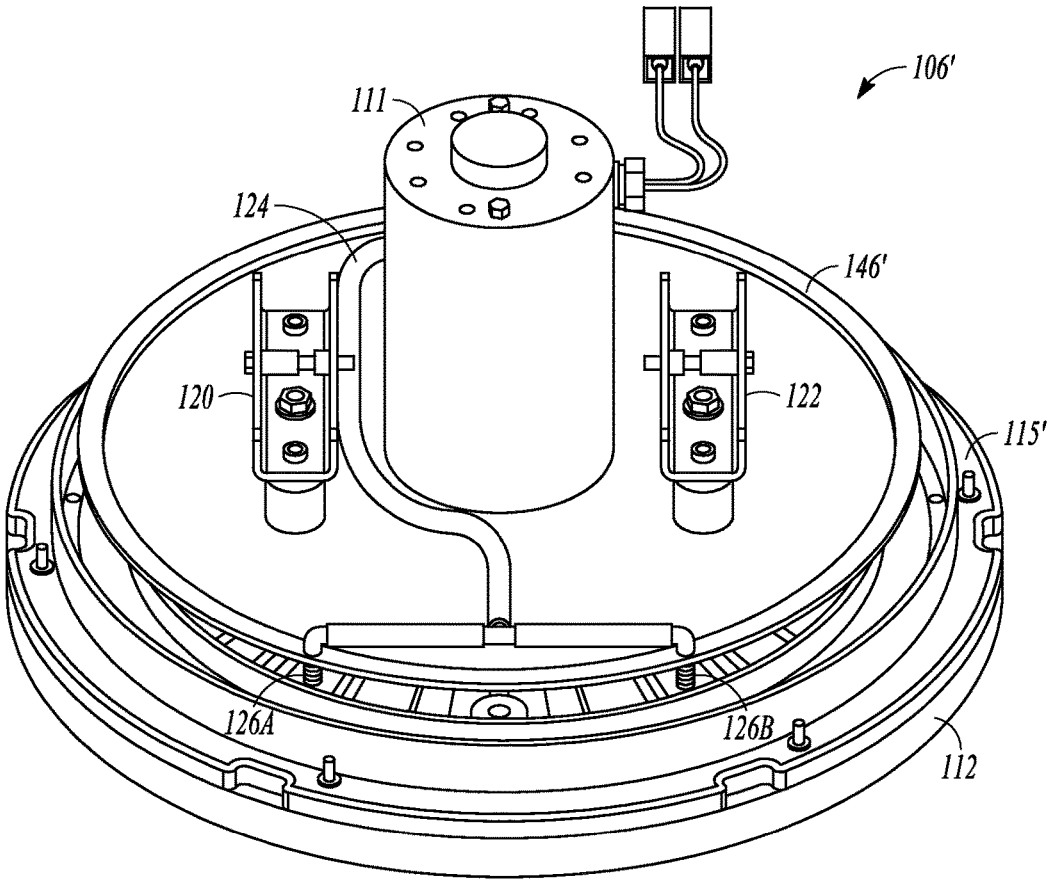
FIG. 14 is a perspective view of another example of a cleaning head assembly in accordance with the present application.
Figure 15:
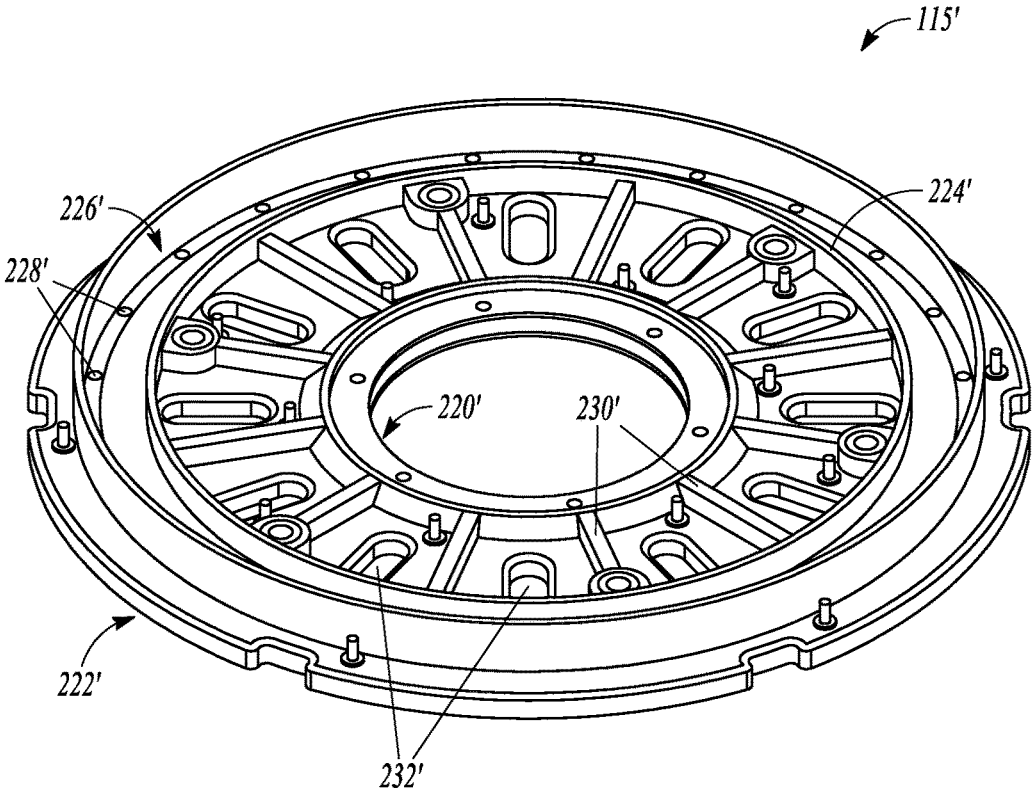
FIG. 15 is a perspective view of a pad driver block contained within the cleaning head assembly of FIG. 14.
Figure 16:
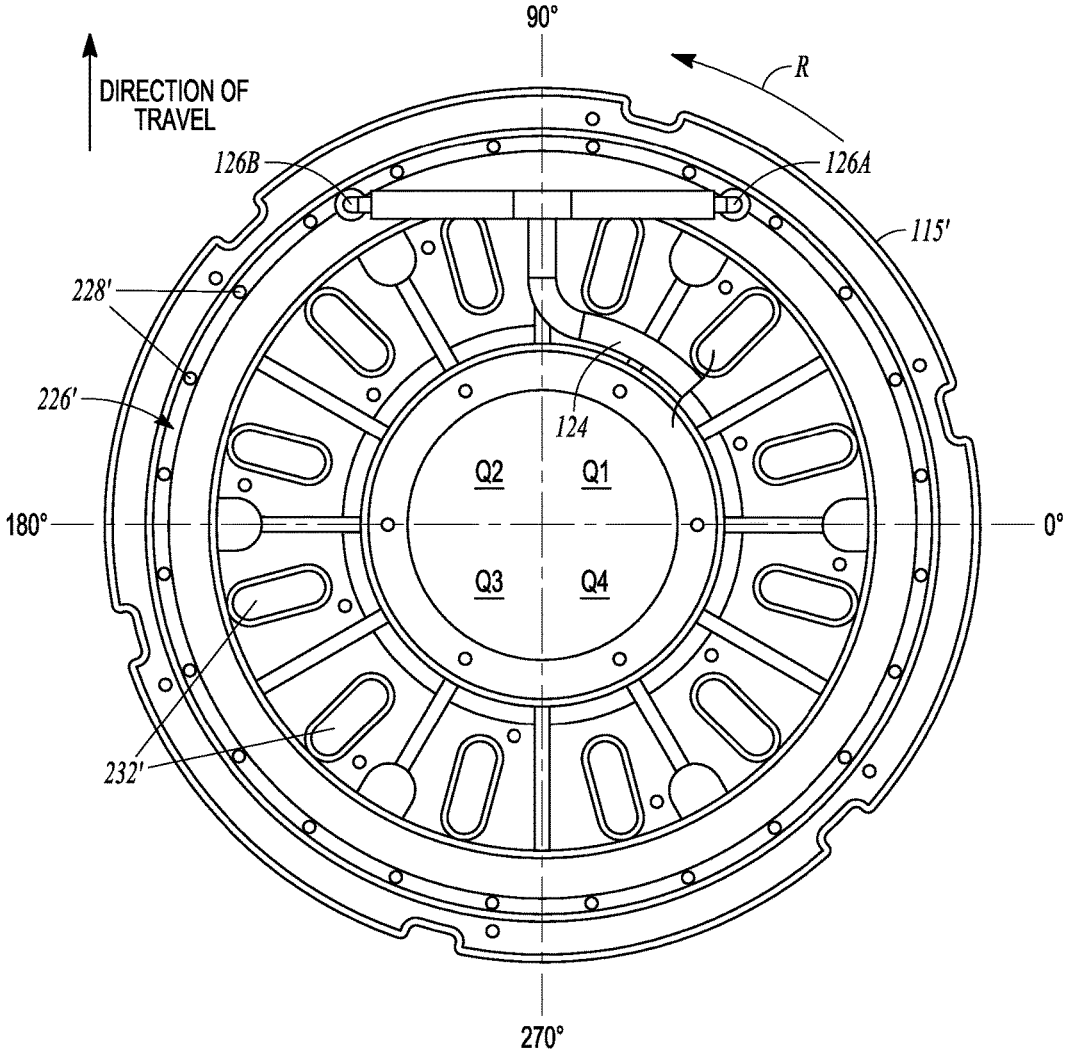
FIG. 16 is a diagram illustrating a top view of the pad driver block of FIG. 15 showing exemplary dispensing locations for the cleaning solution.

The foregoing description sets forth an example of a random orbit disc scrubber 100 that can be configured to dispense cleaning solution at a single dispensing location. However, in other examples, cleaning solution can be dispensed at more than one dispensing location. FIGS. 14-16 describe an example of a random orbit disc scrubber 100 having a cleaning head assembly 106' with multiple dispensing locations. Particularly, the cleaning head assembly 106' is generally similar to the cleaning head assembly 106 described above with reference to FIGS. 2-13, with the exception of a few of the cleaning head components. FIGS. 14-15 illustrate a few of these exemplary modifications.

FIG. 14 is a front perspective view of the cleaning head assembly 106' isolated from the remainder of the scrubber 100 to better show the components of the cleaning head assembly 106'. Compared to the cleaning head assembly 106, the cleaning head assembly 106' includes, for example, a modified motor mounting plate 146', a modified pad driver block 115', and a modified solution dispensing system including a first solution dispenser 126A and a second solution dispenser 126B fluidly coupled to the solution conduit 124. Thus, as will be discussed in further detail below, solution can be dispensed adjacent to a front right portion and a front left portion of the pad driver block 115'.

FIG. 15 is a perspective view of the pad driver block 115' illustrating various design features of the block. As illustrated in FIG. 15, the pad driver block 115' includes an inner region 220' and an outer region 222' separated by a circumferential ridge 224'. Unlike the pad driver block 115 which included a trough 226 defined in the inner region 220, the pad driver block 115' can include a trough 226' defined the outer region 222'. The trough 226' can have having a plurality of apertures 228' for dispensing the cleaning solution to the cleaning element 112. Particularly, cleaning solution can be delivered through the solution conduit 124 and the solution dispensers 126A and 126B to the trough 226' where it can be funneled through the apertures 228' and onto the rotating cleaning element 112.

In the present example, the pad driver block 115' includes twice as many apertures 228' as the number of apertures 228 in the pad driver block 115 (24 versus 12). However, the pad driver blocks 115 and 115' can include any number of apertures 228 and 228', respectively, without departing from the spirit and scope of the application.

As illustrated in FIG. 15, the inner region 220' of the pad driver block 115' includes a plurality of circumferentially spaced ribs 230' that are structured to provide rigidity to the pad driver block 115'. As further illustrated in FIG. 15, the inner region 220' can include a plurality of suitably sized slots 232' for reducing the weight of the pad driver block 115'.

FIG. 16 is a diagram illustrating a top view of the pad driver block 115' showing the dispensing locations of the cleaning solution from the solution dispensers 126A and 126B. Once again, it is assumed that the direction of travel is oriented toward the top of the page as shown, and the direction of rotation R of the pad driver block 115' is counterclockwise.

In the example of FIG. 16, a first dispensing location can be in the first or front right quadrant Q1 as viewed from the top of the pad driver block 115' when the block is rotating in the counterclockwise direction. Further, a second dispensing location can be in the second or front left quadrant Q2. Compared to the dispensing location of the solution dispenser 126 in FIG. 13, the dispensing locations of the solution dispensers 126A and 126B are positioned in the outer region 222' and closer to an outer edge of the pad driver block 115'. It has been found that dispensing the cleaning solution from multiple locations in an outer region of the pad driver block can also result in a fluid distribution that is substantially uniform across the surface area of the cleaning element 112 without expelling any significant amount of solution outside of the cleaning head assembly 106'.

Because the cleaning solution is distributed in both the first or front right quadrant Q1 and the second or front left quadrant Q2 in the foregoing example, reversing the direction of rotation R of the pad driver block 115' will have no significant effect on the fluid distribution to the cleaning element 112.

The features disclosed in the present application can provide future designers of floor scrubbers with a number of design options not previously available. With prior art rotary motion scrubbers such as that illustrated in FIG. 1, solution run time and recovery tank capacity, as opposed to battery run time, have been the primary limiting factors in scrubber design. Thus, the operator must make several solution tank refills and recovery tank disposals before the battery run time ends. However, the random orbit disc scrubber of the present application allows for a reduction in the number of solution tank refills and recovery tank disposals as compared with prior art rotary motion scrubbers. This is possible because combining rotary and orbital movement together in a single machine allows for slower rotary movement and less fluid dispersal as compared to prior art rotary motion scrubbers to achieve the same level and quality of cleaning.

Although the present invention has been described with reference to preferred embodiments, workers skilled in the art will recognize that changes can be made in form and detail without departing from the spirit and scope of the invention.

What is claimed is:

1. A random orbit scrubber, comprising:

a main body having a front end and a rear end;

a cleaning head assembly disposed between the front end and the rear end of the main body and including a cleaning element structured for contact with a floor surface, the cleaning head assembly further including a motor that is operable to impart rotational and orbital movement on the cleaning element; and a squeegee assembly disposed between the cleaning head assembly and the rear end of the main body.

2. The random orbit scrubber of claim 1, further comprising a vacuum recovery system operably coupled to the squeegee assembly.

3. The random orbit scrubber of claim 1, wherein the cleaning element is a cleaning pad.

4. The random orbit scrubber of claim 3, wherein the cleaning pad is flexible.

5. The random orbit scrubber of claim 1, wherein the cleaning element is a cleaning brush.

6. The random orbit scrubber of claim 1, wherein the cleaning head assembly further comprises a cleaning element driver block coupled to the cleaning element, the cleaning element driver block imparting the rotational and orbital movement on the cleaning element.

7. The random orbit scrubber of claim 6, wherein the motor of the cleaning head assembly includes a drive shaft coupled to an eccentric cam, the drive shaft being mounted off-center with respect to the eccentric cam such that a longitudinal center axis of the drive shaft is offset from a longitudinal center axis of the eccentric cam.

8. The random orbit scrubber of claim 7, wherein the cleaning head assembly further comprises:

a motor driver plate fixedly coupled to the cleaning element driver block with one or more fasteners; and a bearing assembly positioned within a journal of the motor driver plate, wherein an internal raceway of the bearing assembly is structured to receive an extension shaft of the eccentric cam to enable rotation of the motor driver plate and the cleaning element driver block relative to the eccentric cam.

9. The random orbit scrubber of claim 8, further comprising a counterweight coupled to an end of the drive shaft, wherein the drive shaft, the eccentric cam, and the counterweight are structured to rotate together during operation of the motor.

10. The random orbit scrubber of claim 9, wherein a center of mass of the counterweight is substantially aligned with a center of mass of the cleaning element driver block.

11. The random orbit scrubber of claim 6, further comprising at least one solution dispenser for dispensing a fluid onto the cleaning element of the cleaning head assembly.

12. The random orbit scrubber of claim 11, wherein the cleaning element driver block includes a plurality of circumferentially spaced holes, and wherein the fluid is dispensed onto the cleaning element driver block such that the fluid drains through the holes and into the cleaning element.

13. The random orbit scrubber of claim 12, wherein the cleaning element driver block defines a circular footprint within the cleaning head assembly including a first quadrant defining a front right portion of the footprint as viewed from a top side of the driver block, a second quadrant defining a front left portion of the footprint as viewed from the top side of the driver block, a third quadrant defining a back left portion of the footprint as viewed from the top side of the driver block, and a fourth quadrant defining a back right portion of the footprint as viewed from the top side of the driver block.

14. The random orbit scrubber of claim 13, wherein the at least one solution dispenser comprises a first solution dispenser positioned at a first dispensing location arranged in the first quadrant.

15. The random orbit scrubber of claim 14, wherein the at least one solution dispenser further comprises a second solution dispenser positioned at a second dispensing location arranged in the second quadrant.

16. The random orbit scrubber of claim 15, wherein the cleaning element driver block is operable to rotate in a counterclockwise direction as viewed from the top side of the driver block.

17. A random orbit scrubber, comprising:

a main body;

a cleaning head assembly extending from an underside of the main body and including a cleaning element structured for contact with a floor surface, the cleaning head assembly further including a motor having a drive shaft that is coupled to an eccentric cam in a manner such that a longitudinal center axis of the drive shaft is offset from a longitudinal center axis of the eccentric cam, wherein the offset coupling between the drive shaft and the eccentric cam is structured to impart rotational and orbital movement on the cleaning element; and a squeegee positioned rearward of the cleaning head assembly.

18. The random orbit scrubber of claim 17, further comprising first and second solution dispensers positioned adjacent to a leading end of the cleaning head assembly, wherein the first and second solution dispensers are operable to dispense a fluid onto a cleaning element driver block coupled to a top side of the cleaning element.

19. The random orbit scrubber of claim 18, wherein the cleaning element driver block includes a circumferential trough for receiving the dispensed fluid from the first and second solution dispensers and funneling the dispensed fluid to the cleaning element through a plurality of spaced holes in the trough.

20. A random orbit cleaning system, comprising:

a main body;

a cleaning element extending below a lower surface of the main body, the cleaning element structured for contact with a floor surface;

a motor operably coupled to the cleaning element for imparting rotational and orbital movement on the cleaning element; and a squeegee extending below the lower surface of the main body.

* * * * *